US005941766A

United States Patent [19]

Iversen

[11] Patent Number: 5,941,766

[45] Date of Patent: Aug. 24, 1999

[54] DUST COLLECTOR

[76] Inventor: Edward P. Iversen, 14 Woodview La., Algonquin, Ill. 60102

[21] Appl. No.: 08/976,873

[22] Filed: Nov. 24, 1997

[51] Int. Cl.[6] ..... B24B 55/06

[52] U.S. Cl. ..... 451/456; 15/301; 83/100; 454/63

[58] Field of Search ..... 15/301, 339, 310; 451/456; 83/106, 168, 169; 144/252.1; 454/63

[56] References Cited

U.S. PATENT DOCUMENTS

| | | | |
|---|---|---|---|
| 2,384,688 | 9/1945 | Litman | 451/456 |
| 2,855,837 | 10/1958 | Bakke | 454/63 |
| 3,008,357 | 11/1961 | Burns | 76/41 |
| 3,096,933 | 7/1963 | Bora | 417/247 |
| 3,321,871 | 5/1967 | Balamuth et al. | 451/28 |
| 3,322,169 | 5/1967 | Hilliard | 83/100 |
| 3,401,724 | 9/1968 | Kreitz | 83/471.3 |
| 3,460,294 | 8/1969 | Stumpf | 451/453 |
| 3,525,183 | 8/1970 | Gargrave | 451/453 |
| 3,745,991 | 7/1973 | Gauthier | 454/63 |
| 3,945,281 | 3/1976 | Kreitz | 83/100 |
| 4,109,144 | 8/1978 | Vidmar | 454/63 |
| 4,192,194 | 3/1980 | Patenaude | 451/456 |
| 4,596,060 | 6/1986 | Schmidt et al. | 15/301 |
| 5,491,870 | 2/1996 | Holmes | 15/301 |
| 5,594,972 | 1/1997 | Iversen | 15/301 |

*Primary Examiner*—M. Rachuba
*Attorney, Agent, or Firm*—Mathew R. P. Perrone, Jr.

[57] ABSTRACT

A fixed torpedo mounted in the center of a funnel assembly for a dust collector removes residue caused by a machining practice applied to a work piece, with enhanced flow characteristics due to the fixed torpedo of a dual cone shape fixedly secured in the funnel.

20 Claims, 2 Drawing Sheets

DUST COLLECTOR

This invention relates to a dust collector and more particularly to a dust collector for use with a grinding machine in a machine shop, having improved flow characteristics.

BACKGROUND OF THE INVENTION

Precision parts are required in many instances. A standard effort to produce these precision parts includes grinding and otherwise treating a surface. This production is typically accomplished in a specialty shops, such as a small machine tool shop or section of a larger organization. During the course of this practice, an amount of dust and grindings, and even sparks can be created. When these dust sparks and grindings are created, it is desirable to control the dusts and grindings and keep them away from the machine tool operator.

The problems caused by dust from grinding are thoroughly discussed in U.S. Pat. No. 5,594,972, which patent has the same inventor as this application and is incorporated herein by reference. The dust cover must keep the dust and grinding residues away from the operator, must permit the operator to see what the area of work and must not otherwise interfere with the function of the grinding machine or other shaping machine. These functions are discussed thoroughly in the referenced patent.

SUMMARY OF THE INVENTION

Among the many objectives of this invention is the provision of a dust collector to remove dust and grindings to a safe area with minimal interference with the work.

Another objective of this invention is to provide a movable dust collector.

Yet another objective of this invention is to provide a dust collector to simplify cleaning of a work area.

Still another objective of this invention is to provide a dust collector to reduce pollution at a work area.

Additionally, an objective of this invention is to a dust collector to provide a good view of the work area.

Also, an objective of this invention is to provide a dust collector with minimized interference with the work piece.

A still further objective of this invention is to provide a dust collector to control sparks in a work area.

Yet a further objective of this invention is to provide a dust collector having a flexible position.

These and other objectives of the invention (which other objectives become clear by consideration of the specification, claims and drawings as a whole) are met by providing a fixed torpedo for a dust collector, the dust collector including a funnel assembly mounted on a flexible arm and provided with a vacuum assist, in order to remove residue caused by a machining practice applied to a work piece, with enhanced flow characteristics due to the fixed torpedo having a dual cone shape fixedly secured in the funnel.

BRIEF DESCRIPTION OF DRAWINGS

FIG. 3 depicts a front plan view of dust collector 100.

Throughout the figures of the drawings where the same part appears in more than one figure the same number is applied thereto.

DESCRIPTION OF PREFERRED EMBODIMENTS

Figure 1:
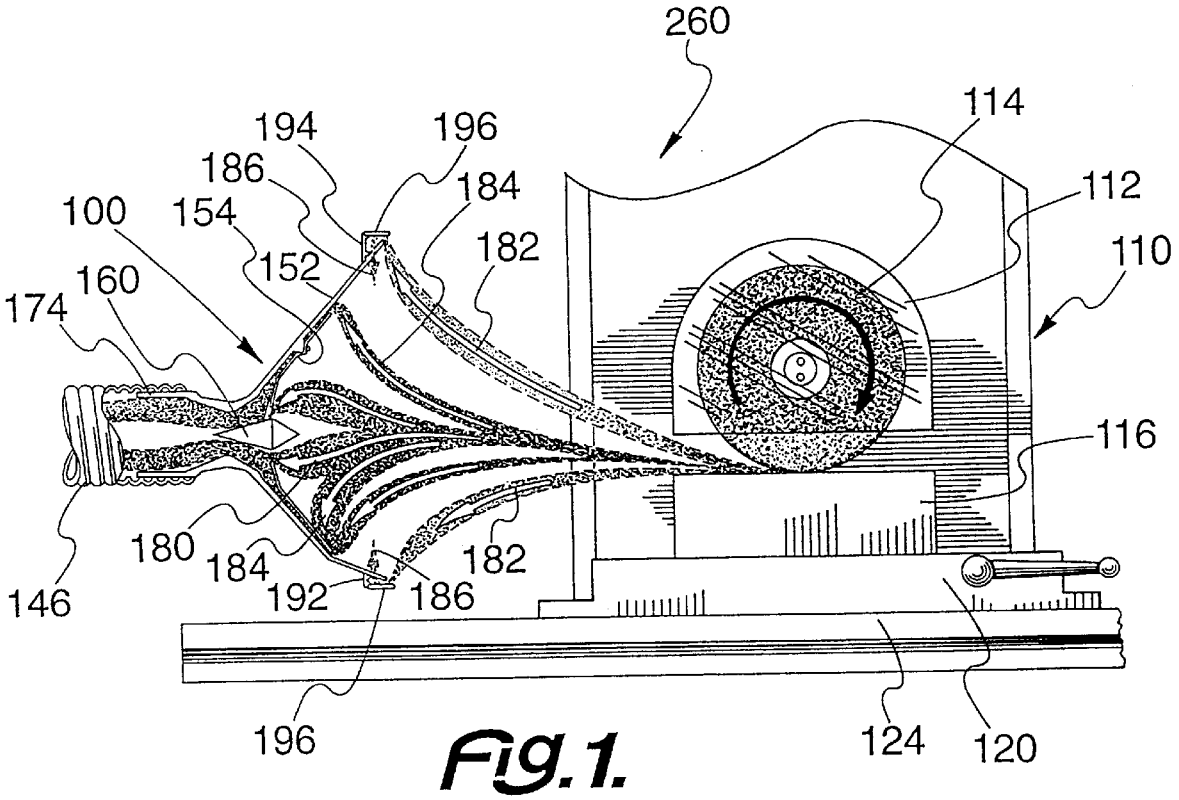
FIG. 1 depicts a side view of standard grinding device 110 with a standard dust guard 112 in position thereon.

A dust collector uses a funnel assembly mounted on an adjustable arm to permit the dust collector to be positioned in relation to the work piece or material being ground, in combination with a vacuum hose to cause safe and efficient removal of residue from a work area. The grinding device includes a grinding wheel and other standard machine tool devices for moving the material under the grinding wheel to be finished or otherwise shaped.

The adjustable dust collector includes a funnel assembly, also known as a dust cone assembly. The wide mouth for the funnel of the dust collector receives the dust from the grinding wheel and directs it to the narrow base of the funnel. The narrow base is connected to a vacuum to assist with the residue collection. All residue from the grinding of the material enter the funnel.

The dust collector described in the above-referenced U.S. Pat. No. 5,594,972 is an effective collector. With this invention the center fixture of the funnel is now mounted in a permanent position and provides an extremely effective dust collection device. A series of three (3) radially spaced mounting brackets form a mounting device, which secures the center fixture to the funnel. The mounting brackets are small enough to permit the dust to flow as freely as ever and provide for the center fixture in view of the fact that the center fixture is basically shaped as two (2) conical-solids joined at the base thereof. The interior conical-solid has a longer height than the funnel contained conical-solid.

Preferably, the height of the interior cone is 1.1 to 5 times the height of the funnel cone. More preferably, the height of the interior cone is 1.3 to 4 times the height of the interior cone. Most preferably, the height of the cone 1.5 to 2.5 times the height of the cone. This cone's structure permits a very efficient dust collection. It also permits the collection while avoiding the formerly necessary ability of the center fixture. In this fashion, a very great problem is solved in a more simple fashion.

Within the base of the plastic funnel is an exhaust channel, which permits dust to flow thereout and into the vacuum hose. The vacuum hose is secured to the funnel by a hose end of the base sleeve. The adjustable arm of the dust collector permits adjustment thereof as desired. With this particular structure of the tube to elbow clamp and adjustments therein, the dust collector can be put in any suitable position around the grinding device as desired.

The dust collector as set forth in U.S. Pat. No. 5,594,972 is an effective collector. The dust collector of this invention is an improvement thereover in that the center fixture is smaller, more effective, and somewhat more simply mounted. A series of three (3) radially spaced mounting brackets secure the center fixture to the funnel. The mounting brackets are small enough to permit the dust to flow as freely as ever and provide for the center fixture in view of the fact that the center fixture is basically shaped as two (2) cones or conical-solids joined at the base thereof. The interior conical-solid has a longer height than the funnel contained conical-solid.

Preferably, the height of the interior cone is 1.1 to 5 times the height of the interior or funnel-contained conical solid. More preferably, the height of the interior cone is 1.3 to 4 times the height of the interior cone. Most preferably, the height of the cone 1.5 to 2.5 times the height of the cone. This cone's structure permits a very efficient dust collection. It also permits the collection while avoiding the formerly necessary ability of the center fixture. In this fashion, a very great problem of dust in a grinding area is solved in a more simple fashion.

Referring now to FIG. 1, the grinding device 110 is depicted with a dust guard 112 in place. The grinding device 110 includes a power grinding wheel 114 and other standard machine tool devices for moving the material 116 under the grinding wheel 114 for a finishing and supporting the material thereon. The stock or material 116 is supported on grinding base 120. Grinding base 120 is in turn supported on a travel table 124, as is typical of a grinding device 110.

Dust collector 100 receives the vacuum, as it is drawn through hose 146, which is connected to the hose end sleeve 174 of dust collector 100. In this manner hose 146 collects sparks 180, dust 182, and grindings 184 into the funnel assembly 140 and transports the residue to a safe place, for eventual recycling or disposal. Sparks 180 are brief light flashes capable of starting a fire created by the grinding process. Dust 182 includes fine particles separated from material 116 by the grinding process. Grindings 184 include larger particles separated from material 116 by the grinding process.

Figure 2:
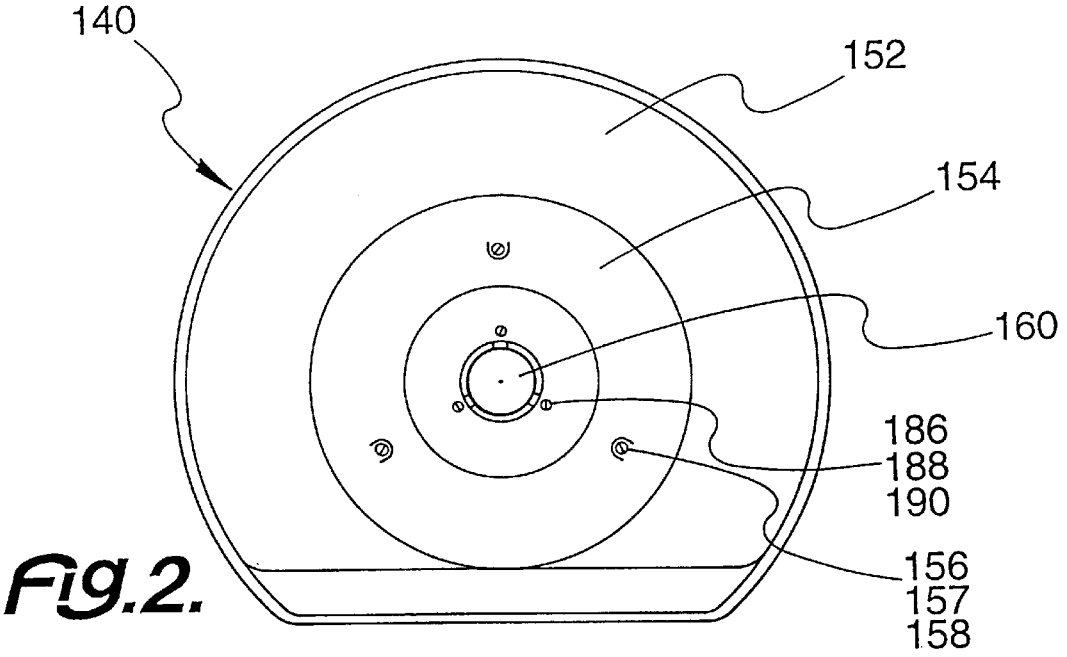
FIG. 2 depicts a front plan view of dust collector 100.
Figure 3:
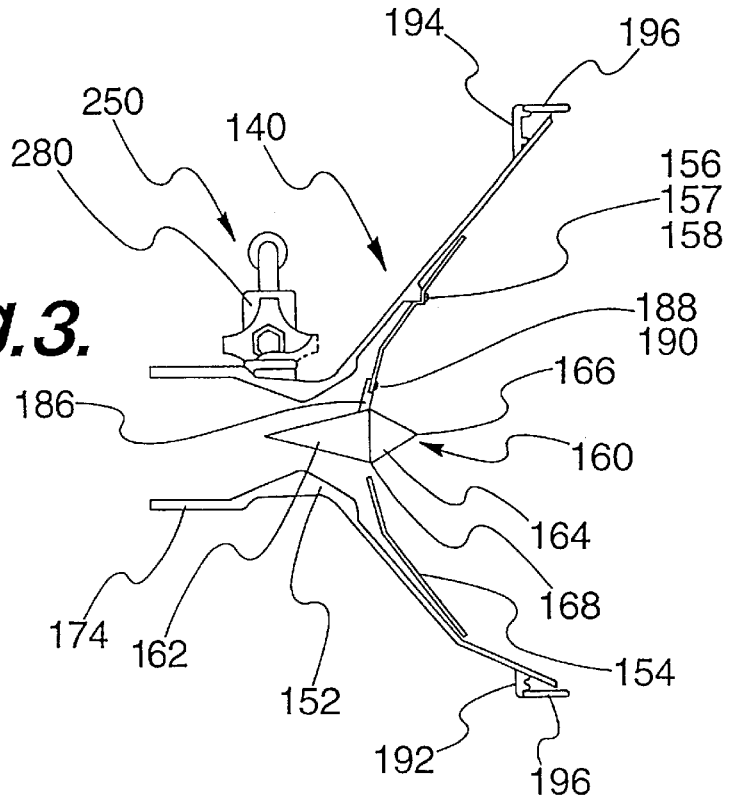
FIG. 3 depicts a side view of a standard grinding device 110 with the dust collector 100 of this invention in place combined with a designed dust trail 130.

In FIG. 2 and FIG. 3, the dust collector 100 shows a plastic funnel housing 152 having contained therein a steel dual-cone 154. In the center of the steel dual-cone 154 are three radially spaced mounting brackets 156. Each mounting bracket 156 supports the steel dual-cone 154, by being secured at one end thereto by welding or other appropriate fastening device. The steel dual-cone 154 is mounted in the plastic funnel housing 152 by fastener screws 157, which fit into apertures 158 within the funnel assembly 140 and hold each mounting bracket 160 therein, by either an aperture or clamping.

So one end of each bracket 156 is secured to torpedo 160. The other end of each bracket 156 is secured to funnel housing 152. When three of bracket 156 are used in a radial spacing, the triangulated support permits strong support for torpedo 160, while leaving the opening adequate for any dust flow, and minimizing moving parts.

Torpedo 160 has the form of two (2) conical-solids joined at the base thereof. The interior conical-solid 162 has a longer height than the funnel contained conical-solid 164. Funnel contained conical solid 164 has an inner conical tip 166 protruding through the plastic funnel housing 152 into the funnel assembly 140. The inner conical tip 166 extends into shared base 168 with interior conical-solid 162. Interior conical solid 162 has a hose tip 180 extending into the hose 146.

Figure 4:
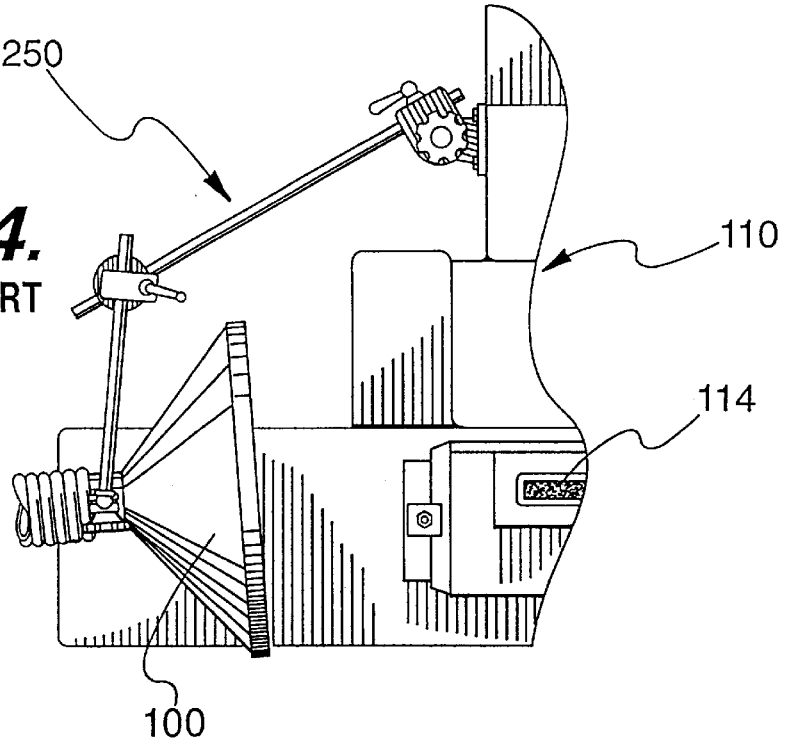
Fig.4. PRIOR ART
FIG. 4 depicts a side view of the dust collector 100 of this invention used with the adjustable mount system 250 of the prior art, as defined in the applicant's prior patent, as referenced herein.

With this structure, it thus becomes possible to move funnel assembly 140 into operating position 260 adjacent to the grinding wheel 114 (FIG. 1). The adjustable mount system 250 of FIG. 4 makes this clearly possible by permitting the movement of the funnel assembly 140 into operating position 260, to collect the sparks 180, dust 182 or grindings 184.

While various parts of funnel assembly 140 are described as being made of aluminum, steel or plastic; it is clear that other materials may be used. The criticality is that the various parts have the desired durability and structure required to survive for a substantial period of time in the somewhat harsh environment of a machine shop.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

1. In a dust collector having a funnel assembly mounted on an adjustable arm to permit the dust collector to be positioned in relation to a grinding device in order to receive dust therefrom while a work piece is being ground, the improvement comprising:

(a) a center fixture for the dust collector being supported therein;

(b) a mounting bracket holding the center fixture in a fixed position within the dust collector; and (c) the center fixture having a generally conical shape.

2. The dust collector of claim 1 further comprising:

(a) a mounting device supporting the center fixture in the dust collector;

(b) the mounting device including a series of brackets to support the center fixture;

(c) the dust collector including a funnel; and (d) the funnel receiving the mounting device.

3. The dust collector of claim 2 further comprising:

(a) the series of brackets including three mounting brackets; and (b) the three mounting brackets being radially spaced about the funnel in order to secure the center fixture to the funnel.

4. The dust collector of claim 3 further comprising:

(a) the three mounting brackets being small enough to permit the dust to flow into the dust collector; and (b) the center fixture being a torpedo adapted to assist the flow of dust through the dust collector.

5. The dust collector of claim 4 further comprising:

(a) the center fixture being formed from a first conical solid and a second conical solid;

(b) the first conical solid having a first base with a first diameter;

(c) the second conical solid having a second base with a second diameter;

(d) the first diameter being equal to the second diameter; and (e) the first conical solid being joined at its first base to the second base.

6. The dust collector of claim 5 further comprising:

(a) the first conical solid being an interior conical-solid;

(b) the second conical solid being within the funnel oppositely disposed from the interior conical solid; and (c) the first conical solid having a longer height than the second conical solid.

7. The dust collector of claim 6 further comprising the first conical solid having a height 1.1 to 5 times the height of the second conical solid.

8. The dust collector of claim 6 further comprising the first conical solid having a height 1.3 to 4 times the height of the second conical solid.

9. The dust collector of claim 6 further comprising the first conical solid having a height 1.5 to 2.5 times the height of the second conical solid.

10. In a dust collector having a funnel assembly mounted on an adjustable arm to permit the dust collector to be positioned in relation to a grinding device in order to receive dust therefrom while a work piece is being ground, the improvement comprising:

(a) a center fixture for the dust collector being supported therein;

(b) a mounting bracket holding the center fixture in a fixed position within the dust collector; and (c) the center fixture having a generally dual conical shape; and (d) the dual conical shape having a shorter end being positioned to contact or receive the dust first.

11. The dust collector of claim 10 further comprising:

(a) a mounting device supporting the center fixture in the dust collector;

(b) the mounting device including a series of brackets to support the center fixture;

(c) the dust collector including a funnel; and (d) the funnel receiving the mounting device.

12. The dust collector of claim 11 further comprising:

(a) the series of brackets including three mounting brackets; and (b) the three mounting brackets being radially spaced about the funnel in order to secure the center fixture to the funnel.

13. The dust collector of claim 12 further comprising:

(a) the three mounting brackets being small enough to permit the dust to flow into the dust collector; and (b) the center fixture being a torpedo adapted to assist the flow of dust through the dust collector.

14. The dust collector of claim 13 further comprising:

(a) the center fixture being formed from a first conical solid and a second conical solid;

(b) the first conical solid having a first base with a first diameter;

(c) the second conical solid having a second base with a second diameter;

(d) the first diameter being equal to the second diameter; and (e) the first conical solid being joined at its first base to the second base.

15. The dust collector of claim 14 further comprising:

(a) the first conical solid being an interior conical-solid;

(b) the second conical solid being within the funnel oppositely disposed from the interior conical solid; and (c) the first conical solid having a longer height than the second conical solid.

16. The dust collector of claim 15 further comprising the first conical solid having a height 1.1 to 5 times the height of the second conical solid.

17. The dust collector of claim 15 further comprising the first conical solid having a height 1.3 to 4 times the height of the second conical solid.

18. The dust collector of claim 15 further comprising the first conical solid having a height 1.5 to 2.5 times the height of the second conical solid.

19. A method of attaching a torpedo in a dust collector having a funnel assembly and an adjustable arm, the funnel assembly being mounted on the adjustable arm to permit the dust collector to be positioned in relation to a grinding device in order to receive dust therefrom while a work piece is being ground, the improvement comprising:

(a) forming the torpedo to have a first conical solid and a second conical solid;

(1) the first conical solid having a first base with a first diameter;

(2) the second conical solid having a second base with a second diameter;

(3) the first diameter being equal to the second diameter;

(e) the first conical solid being joined at its first base to the second base;

(b) forming a mounting bracket for the torpedo in the funnel assembly;

(c) mounting the torpedo in the funnel assembly.

20. The method of claim 19 further comprising the mounting bracket having three arms supporting the torpedo in the funnel assembly.

* * * * *